US010792780B2

(12) United States Patent
Masatoshi et al.

(10) Patent No.: US 10,792,780 B2
(45) Date of Patent: Oct. 6, 2020

(54) SANDER

(71) Applicant: Nanjing Chervon Industry Co., Ltd., Nanjing (CN)

(72) Inventors: Fukinuki Masatoshi, Nanjing (CN); Bing Han, Nanjing (CN)

(73) Assignee: Nanjing Chervon Industry Co., Ltd., Nanjing (CN)

( * ) Notice: Subject to any disclaimer, the term of this patent is extended or adjusted under 35 U.S.C. 154(b) by 293 days.

(21) Appl. No.: 15/910,587

(22) Filed: Mar. 2, 2018

(65) Prior Publication Data

US 2018/0250789 A1 Sep. 6, 2018

(30) Foreign Application Priority Data

Mar. 6, 2017 (CN) ..... 2017 1 0127230

(51) Int. Cl.

| | |
|---|---|
| ***B24B 23/04*** | (2006.01) |
| ***B24B 47/12*** | (2006.01) |
| ***B24B 23/00*** | (2006.01) |
| ***B24B 55/10*** | (2006.01) |
| ***B24B 23/02*** | (2006.01) |
| ***B25F 5/02*** | (2006.01) |

(52) U.S. Cl.

CPC ..... *B24B 23/04* (2013.01); *B24B 23/00* (2013.01); *B24B 23/028* (2013.01); *B24B 47/12* (2013.01); *B24B 55/105* (2013.01); *B25F 5/02* (2013.01)

(58) Field of Classification Search

CPC ..... B24B 23/04; B24B 23/00; B24B 23/028; B24B 47/12; B24B 55/105; B25F 5/02

See application file for complete search history.

(56) References Cited

U.S. PATENT DOCUMENTS 6,971,951 B2 * 12/2005 Boyer ..... B24B 23/00 451/344
2017/0348842 A1 * 12/2017 Blum ..... B25F 5/00
2018/0056473 A1 * 3/2018 Fisher ..... B24B 23/02

FOREIGN PATENT DOCUMENTS

WO 2014119133 A1 8/2014

* cited by examiner

*Primary Examiner* — Dung Van Nguyen
(74) *Attorney, Agent, or Firm* — Greenberg Traurig, LLP

(57) ABSTRACT

A sander includes a motor, a housing, a battery pack, a baseplate and a driving assembly. The motor includes a motor shaft configured to rotate around a first axis. The housing includes an accommodating portion for accommodating the motor. The battery pack is configured to power the motor. The baseplate includes a baseplate plane for arranging sandpaper. The driving assembly is configured to drive at least the baseplate to move eccentrically. The housing is further provided with a first grip portion, a second grip portion, and a coupling portion. The first grip portion is configured to be gripped by one hand of a user. The second grip portion is configured to be gripped by another hand of the user.

7 Claims, 12 Drawing Sheets

SANDER

CROSS-REFERENCES TO RELATED APPLICATIONS

This application claims priority to Chinese patent application No. CN 201710127230.8, filed on Mar. 6, 2017, the disclosure of which is incorporated herein by reference in its entirety.

TECHNICAL FIELD

The present disclosure relates generally to a sander and, in particular, to a DC sander.

BACKGROUND

In the field of electric tools, a sander is a commonly used electric tool for sanding the surface of wood work. The sander includes a motor, a driving assembly and a baseplate. The driving assembly can drive at least the baseplate to move eccentrically. Sandpaper or other sanding members are mounted on the lower surface of the baseplate. The sanding members move along with the baseplate to sand and polish the surface to be processed.

Sanders are classified into DC sanders and AC sanders according to power supply modes. The DC sander further includes a battery pack for powering the motor. However, the position of the battery pack of the sander is configured unreasonably at present, making a user easily feel tired and causing unstable operations.

SUMMARY

In one aspect of the disclosure, a sander includes a motor, a housing, a battery pack, a baseplate and a driving assembly. The motor includes a motor shaft configured to rotate around a first axis. The housing includes an accommodating portion for accommodating the motor. The battery pack is configured to power the motor. The baseplate includes a baseplate plane for arranging sandpaper. The driving assembly is configured to drive the baseplate to make an eccentric motion. The housing is further provided with a first grip portion, a second grip portion and a coupling portion. The first grip portion is configured to be gripped by one hand of a user. The second grip portion is configured to be gripped by another hand of the user. The coupling portion is configured to detachably couple the battery pack to the housing. The battery pack is located between the first grip portion and the second grip portion when the battery pack is coupled to the housing.

Further, the first grip portion, the battery pack and the second grip portion may be aligned in a straight line parallel to the baseplate plane.

Further, the first grip portion may extend in the straight line, and a length of the first grip portion in the straight line may be greater than a length of the second grip portion in the straight line.

Further, the coupling portion may be located between the motor and the first grip portion in a direction parallel to the baseplate plane.

Further, the battery pack may be located between the accommodating portion and the first grip portion when the battery pack is coupled to the housing.

Further, the coupling portion may be further provided with a guide structure configured to guide the battery pack to be coupled to the coupling portion in a direction parallel to the first axis.

Further, the housing may further include a connecting portion configured to connect the first grip portion to the accommodating portion. The connecting portion may be provided with a receiving space for receiving the battery pack.

Further, the housing may further be provided with a recess configured to accommodate the battery pack, and the coupling portion may be located on a recess wall of the recess with the recess being located between the accommodating portion and the first grip portion.

Further, a projection of the first grip portion on a plane parallel to the baseplate plane may be outside a projection of the baseplate on the plane.

Further, the housing may be further provided with a dust collection portion for mounting a dust collection box. The first grip portion, the battery pack and the dust collection portion may be located on a same side of the motor when the battery pack is coupled to the housing.

The sander can be operated stably by both hands of the user.

DETAILED DESCRIPTION

Figure 1:
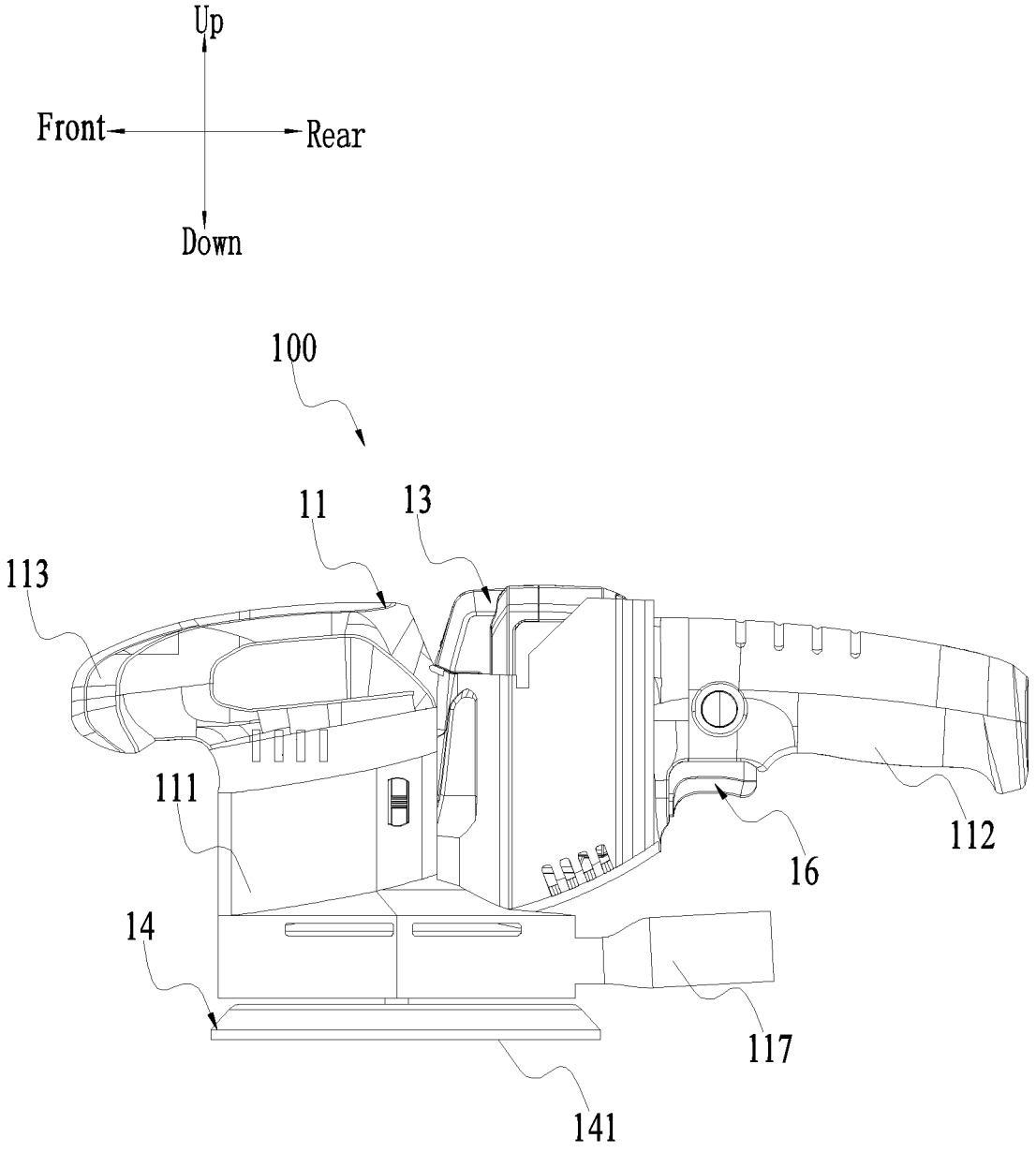
FIG. 1 is a plan view of an exemplary sander.
Figure 2:
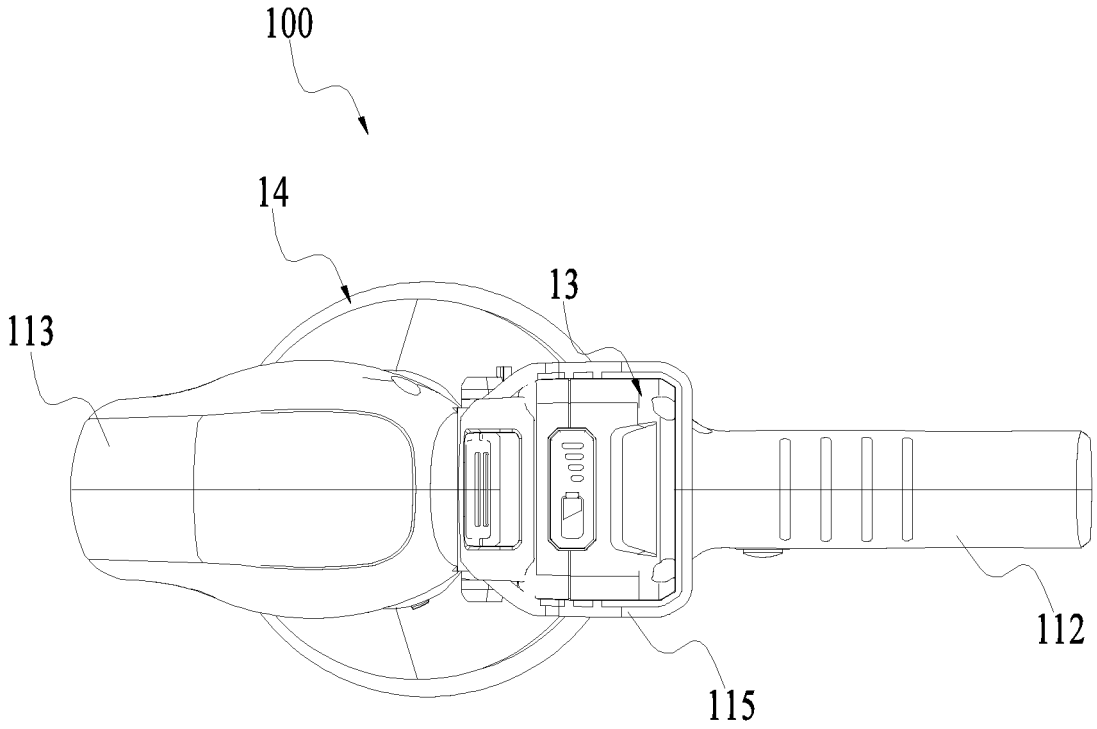
FIG. 2 is a top view of the sander of FIG. 1.
Figure 3:
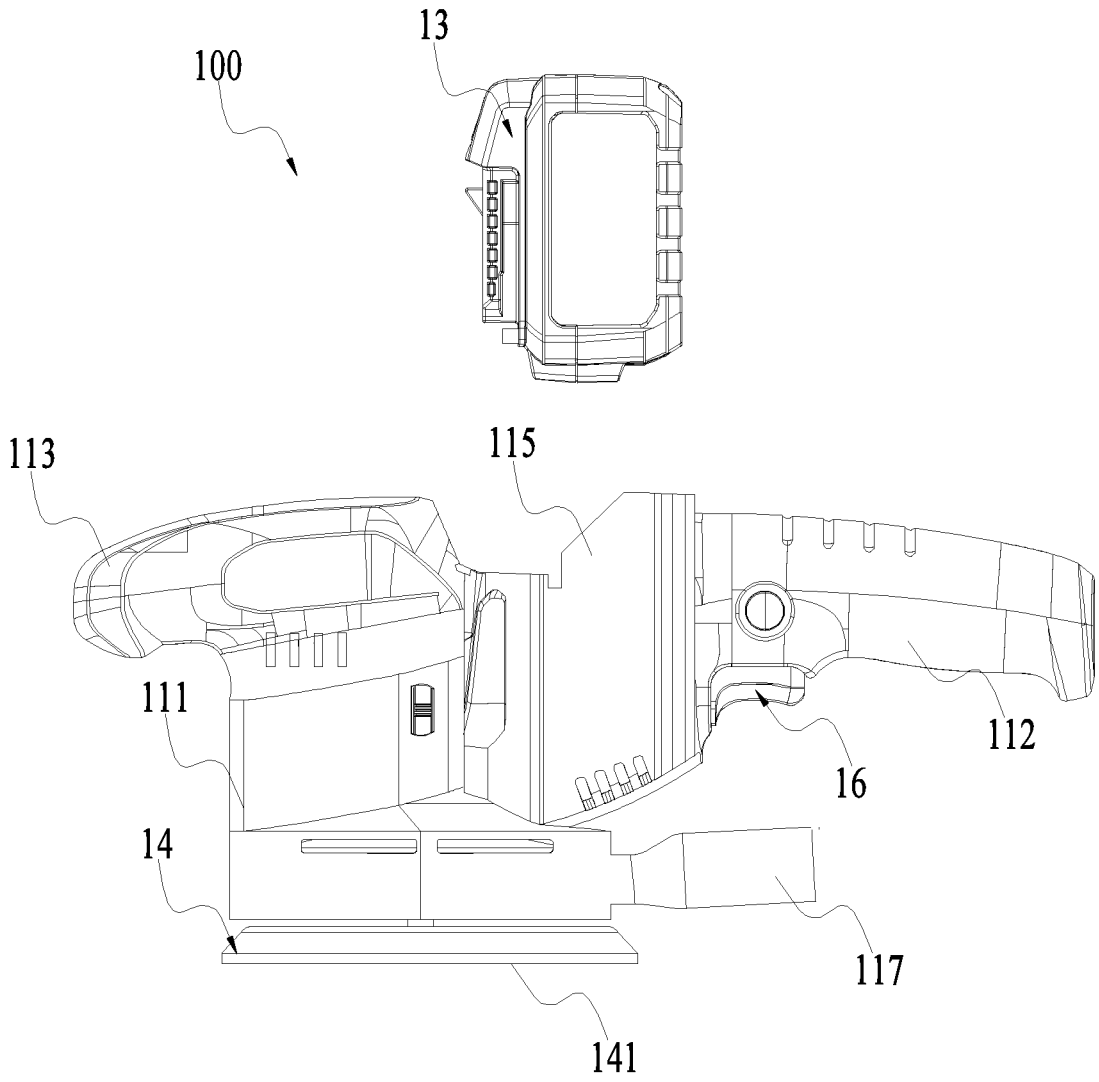
FIG. 3 is a plan view of the sander of FIG. 1 after a battery pack has been separated from the sander.
Figure 4:
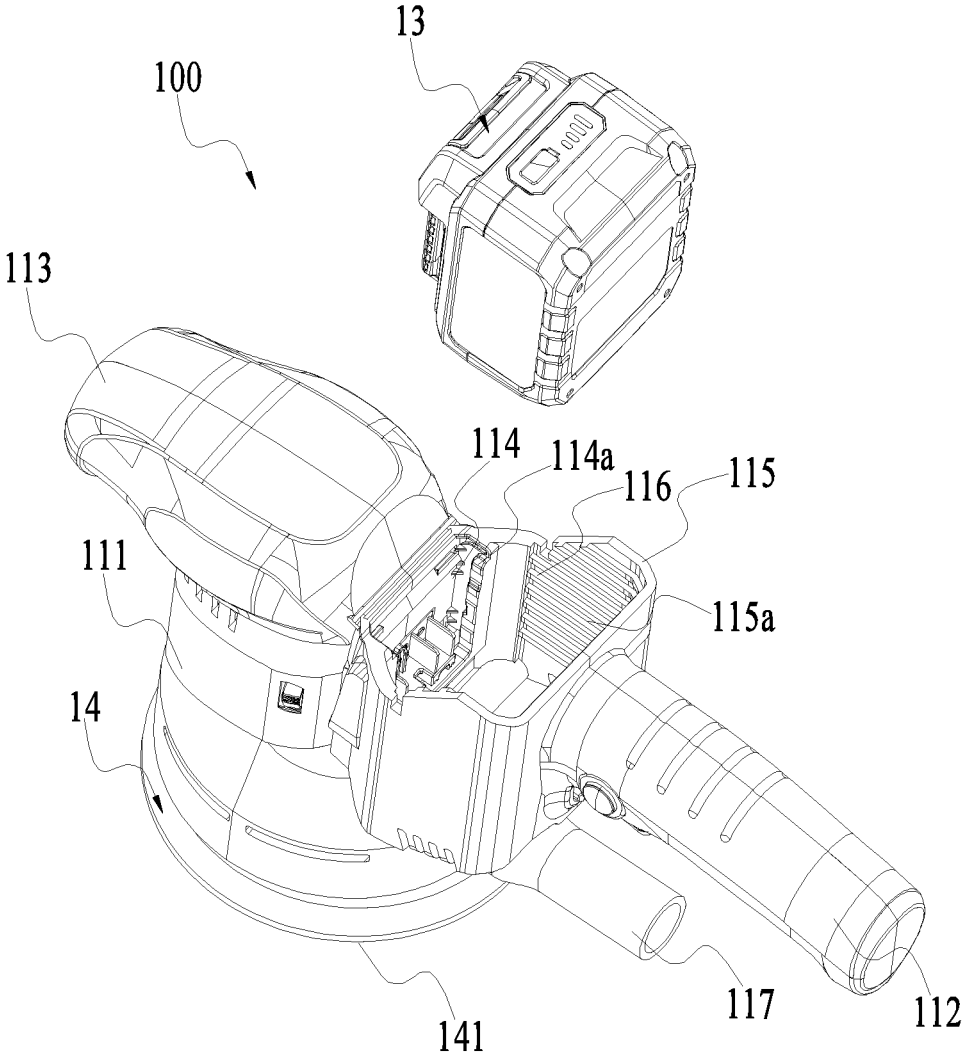
FIG. 4 is a perspective view of a structure of FIG. 3.
Figure 5:
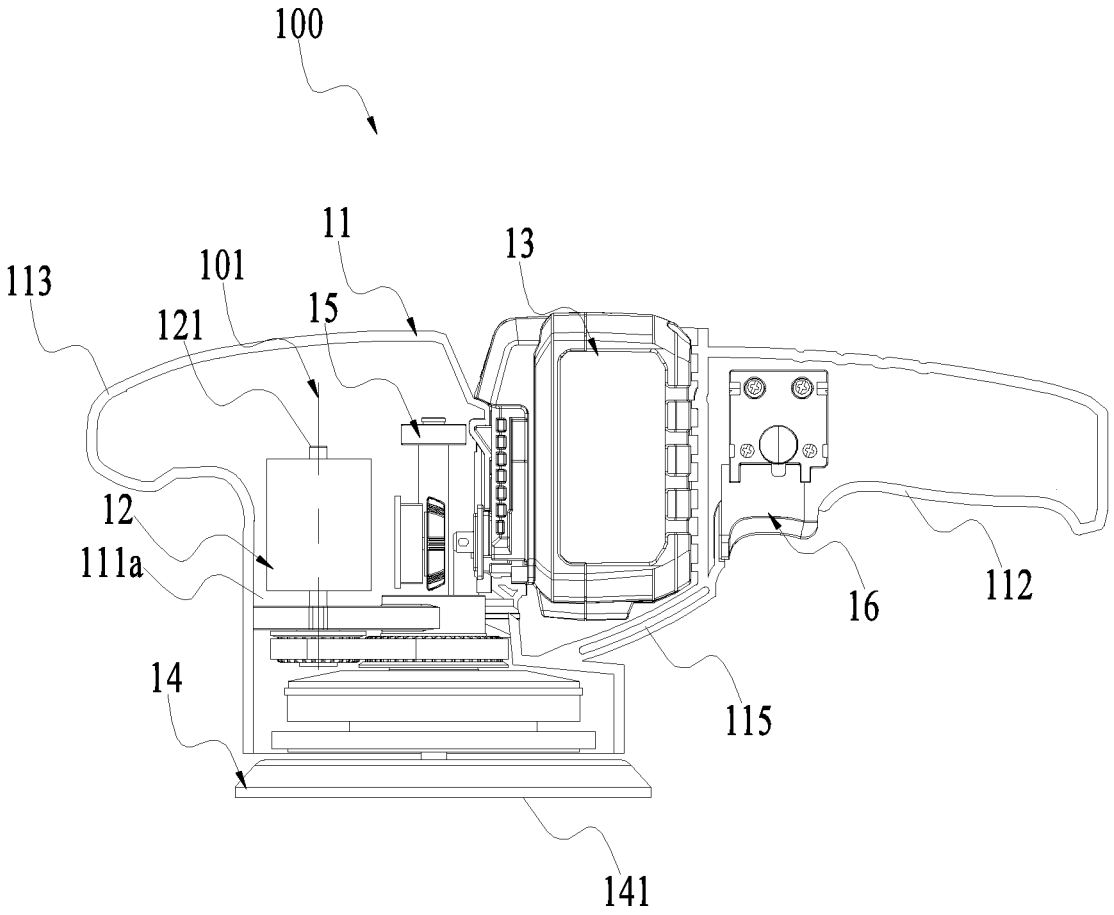
FIG. 5 is a view of the sander of FIG. 1 after a part of a housing has been removed.

An example sander 100, as shown in FIG. 1, can be gripped with both hands so as to be operated. When using the sander 100, a user can hold two grip portions of the sander 100 simultaneously with both hands so that the sander 100 has good controllability in vertical working conditions and horizontal working conditions and so that it is easy for the user to exert force on the sander 100 and thus the user does not feel tired after working for a long time.

As illustrated in FIGS. 1 to 5, the sander 100 includes a housing 11, a motor 12, a battery pack 13, a baseplate 14, a driving assembly 15 and a trigger 16. The housing 11 is used for forming the overall appearance of the sander 100.

The housing 11 further includes an accommodating portion 111 for accommodating the motor 12. A cavity 111*a* is formed in the accommodating portion 111. The motor 12 and the driving assembly 15 are both disposed in the cavity 111*a*.

The motor 12 includes a motor shaft 121 capable of rotating around a first axis 101. The driving assembly 15 is configured to establish a driving connection between the motor 12 and the baseplate 14. The driving assembly 15 can drive the baseplate 14 to revolve around a straight line parallel to the first axis 101 or drive the baseplate 14 to rotate on its own axis while revolving so as to make the baseplate 14 move eccentrically. For example, in the case of an orbital sander 100, the driving assembly 15 only drives the baseplate 14 to revolve and the rotation of the baseplate 14 is inhibited; in the case of a circular sander 100, the driving assembly 15 not only drives the baseplate 14 to revolve, but also drives the baseplate 14 to rotate on its own axis at the same time. The baseplate 14 includes a baseplate plane 141 for arranging, i.e., holding, the sandpaper. The baseplate plane 141 is vertical to the first axis 101 around which the motor 12 rotates. The trigger 16 is used by the user to start the sander 100. The trigger 16 is provided on the housing 11.

To facilitate the description of the solutions of the present disclosure, an up-down direction and a front-rear direction are defined as illustrated in FIG. 1. The up-down direction is vertical to the baseplate plane 141. The front-rear direction is parallel to the baseplate plane 141.

The housing 11 is further provided with a first grip portion 112, a second grip portion 113, a coupling portion 114 and a connecting portion 115. The first grip portion 112 and the second grip portion 113 are configured to be gripped by two hands when the user operates the sander 100. The coupling portion 114 is configured such that the battery pack 13 is detachably coupled to the housing 11. The connecting portion 115 is configured to connect the accommodating portion 111 and the first grip portion 112. The battery pack 13 is located between the first grip portion 112 and the second grip portion 113 when the battery pack 13 is coupled to the housing 11. In this way, the position of the battery pack 13 is reasonably configured so that the center of gravity of the sander 100 is located between the first grip portion 112 and the second grip portion 113, thereby facilitating more stable operations by the user, and so that the user does not feel tired after using the sander 100 for a long time.

Specifically, for the entire sander 100, the first grip portion 112 is located at the rear side of the sander 100 and the second grip portion 113 is located at the front side of the sander 100. In this embodiment, the first grip portion 112 extends rearward in the straight line while the second grip portion 113 extends forward in the straight line, and in the straight line, the first grip portion 112 protrudes rearward with respect to the baseplate 14 while the second grip portion 113 protrudes forward with respect to the baseplate 14. Further, a projection of the first grip portion 112 on a plane parallel to the baseplate plane 141 is outside a projection of the baseplate 14 on the plane. It is also contemplated that the second grip portion 113 located at the front side of the sander 100 may be arranged to not protrude forward with respect to the baseplate 14. For example, the upper portion of the accommodating portion 111 of the housing 11 may serve as the second grip portion 113.

In this illustrated example, the length of the first grip portion 112 in the straight line is larger than the length of the second grip portion 113 in the straight line. The trigger 16 may be disposed below the first grip portion 112, so that the sander 100 can be easily started when the user holds the first grip portion 112.

The housing 11 is further provided with a recess 116 capable of accommodating the battery pack 13. The coupling portion 114 is located on a recess wall of the recess 116. The recess 116 is located between the accommodating portion 111 and the first grip portion 112. In this way, in a direction parallel to the baseplate plane 141, the coupling portion 114 is located between the motor 12 and the first grip portion 112. The coupling portion 114 is further provided with a guide structure 114*a* for guiding the battery pack 13 to be coupled to the coupling portion 114 in a direction parallel to the first axis 101 so that the battery pack 13 is inserted into the recess 116 in the direction parallel to the first axis 101. A receiving space 115*a* is enclosed by the connecting portion 115. In this example, the receiving space 115*a* is opened upward in the direction parallel to the first axis 101 to form the above-mentioned recess 116. Of course, it is to be understood that the connecting portion 115 may further allow the first grip portion 112 to be detachably connected to the accommodating portion 111.

Further, the housing 11 is provided with a dust collection portion 117 for mounting a dust collection box for collecting dust. The dust collection portion 117, the first grip portion 112 and the battery pack 13 are at the rear side of the motor 12.

In this way, when the battery pack 13 is coupled to the housing 11, the first grip portion 112, the battery pack 13, the motor 12 and the second grip portion 113 are substantially aligned in a straight line parallel to the baseplate plane 141, the straight line extends in the front-rear direction, and the battery pack 13 is located between the accommodating portion 111 and the first grip portion 112. The user can conveniently insert the battery pack 13 into the recess 116, and after the battery pack 13 is coupled to the coupling portion 114, the center of gravity of the sander 100 is located between the first grip portion 112 and the second grip portion 113, thereby making it easy for the user to operate the sander 100 stably.

Figure 6:
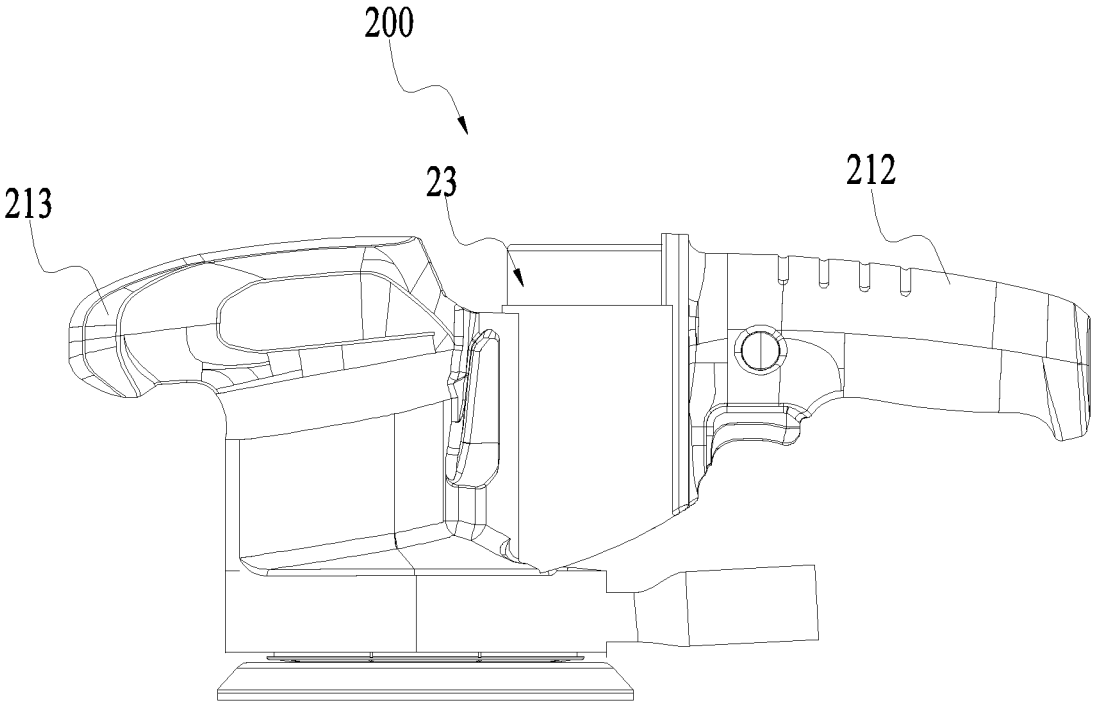
FIG. 6 is also a plan view of an exemplary sander.
Figure 7:
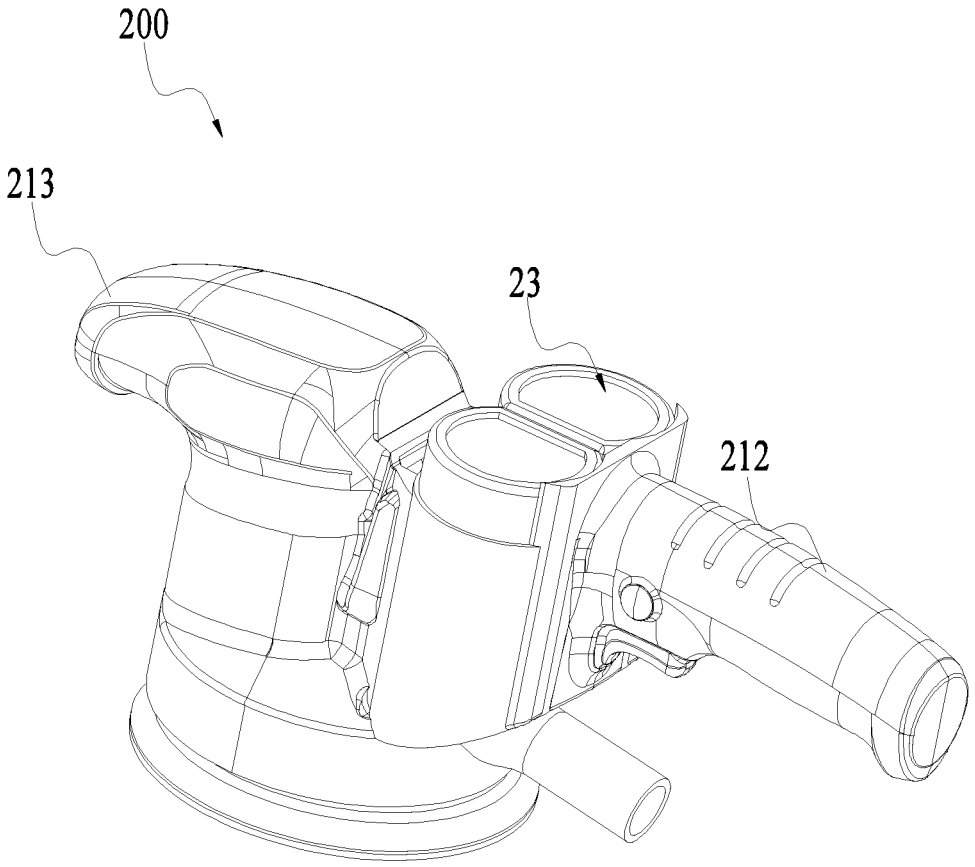
FIG. 7 is a perspective view of the sander of FIG. 6.

FIGS. 6 and 7 illustrate another example of a sander 200. The sander 200 differs from the sander 100 only in that the sander 200 includes two battery packs 23. The two battery packs 23 are both disposed between a first grip portion 212 and a second grip portion 213. The parts described above with respect to sander 100 and suitable for sander 200 can all be applied to this example and, as such, the details are not described herein again.

Figure 8:
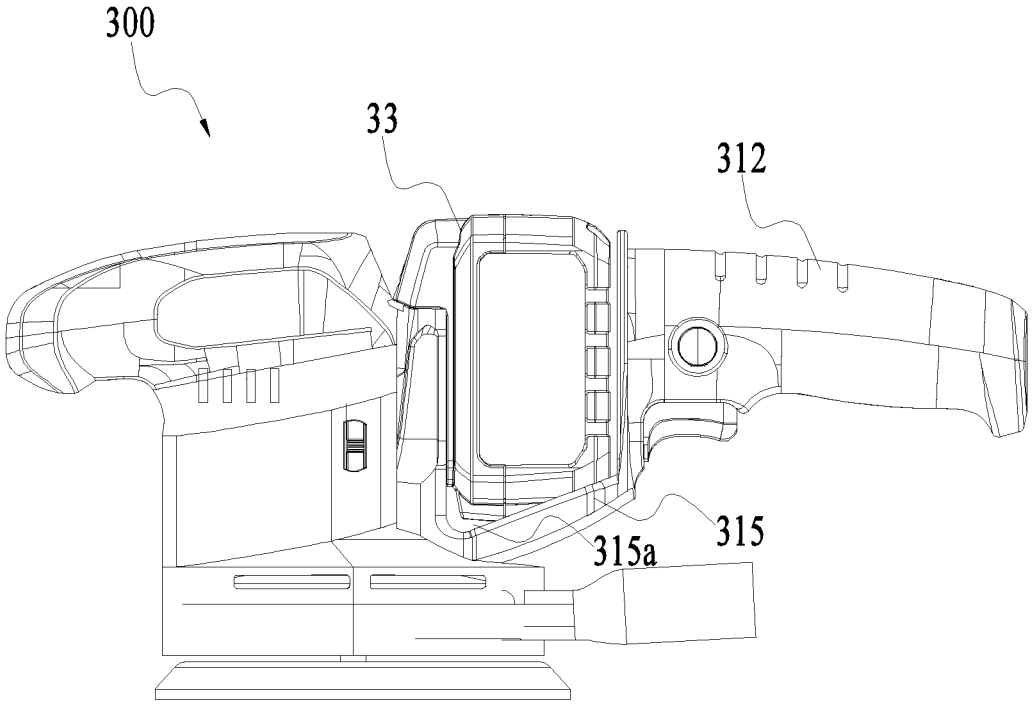
FIG. 8 is also a plan view of an exemplary sander.
Figure 9:
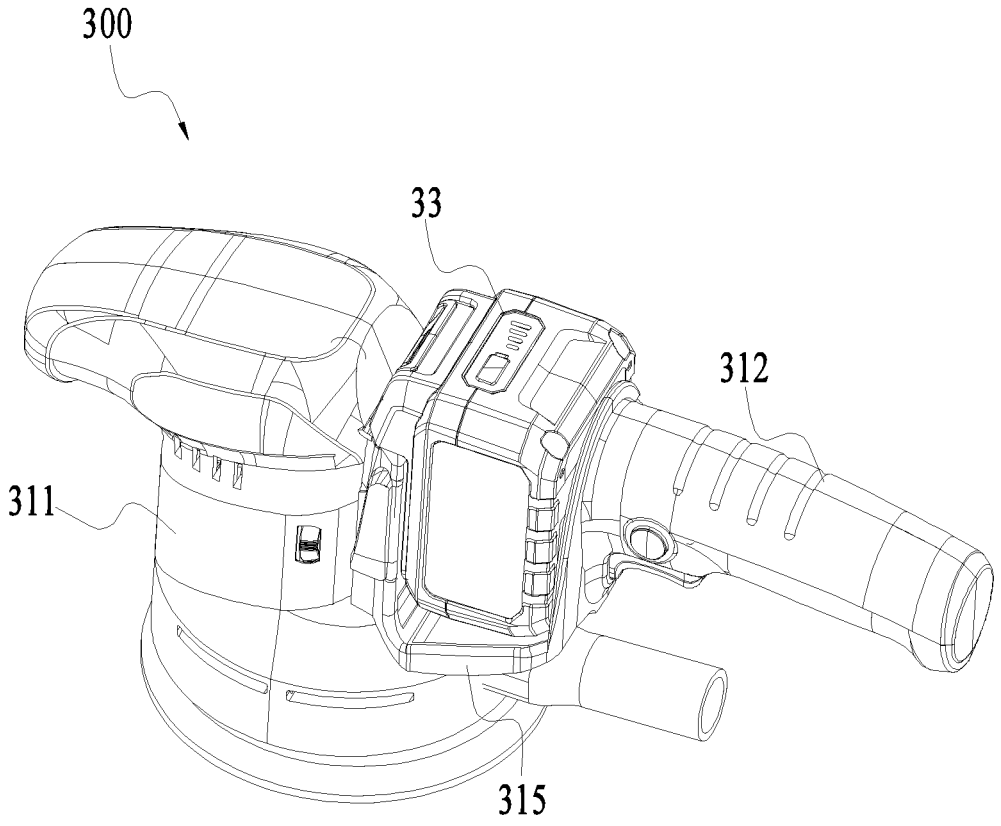
FIG. 9 is a perspective view of the sander of FIG. 8.

FIGS. 8 and 9 illustrate a sander 300. The sander 300 differs from the sander 100 only in that a structure of a connecting portion 315 is different from the structure of the connecting portion 115. In this example, the connecting portion 315 is configured to connect an accommodating portion 311 to a first grip portion 312. The connecting portion 315 makes the accommodating portion 311 and the first grip portion 312 to be spaced apart to form a receiving space 315*a* for receiving a battery pack 33 so as to further facilitate heat dissipation of the battery pack 33. The parts described with respect to the sander 100 and suitable for the sander 300 can all be applied to this example and, as such, the details are not described herein again.

Figure 10:
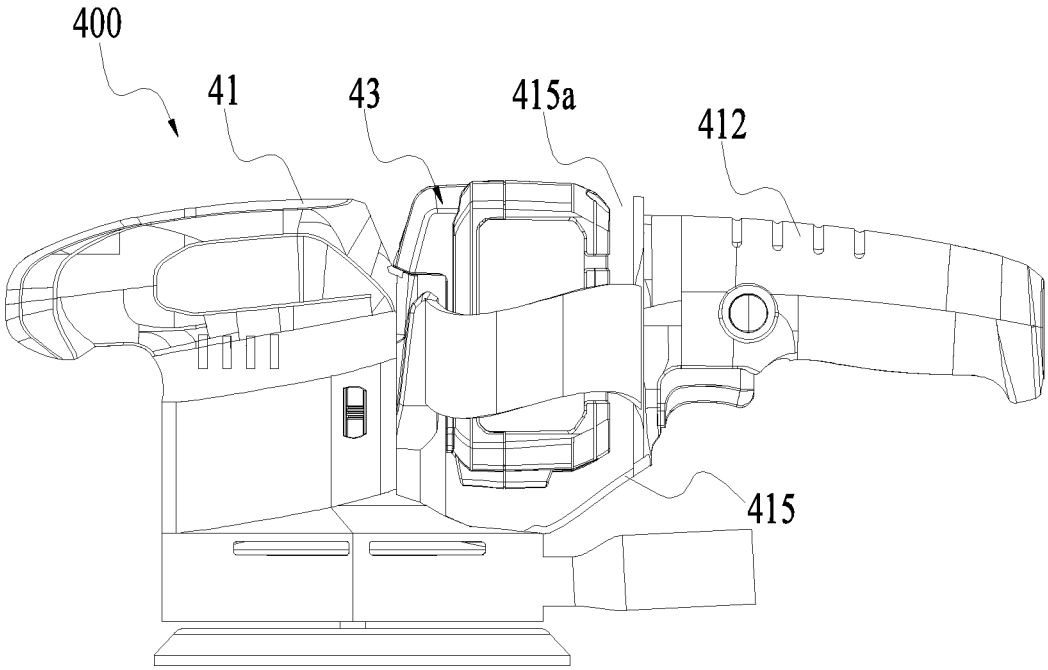
FIG. 10 is also a plan view of an exemplary sander.
Figure 11:
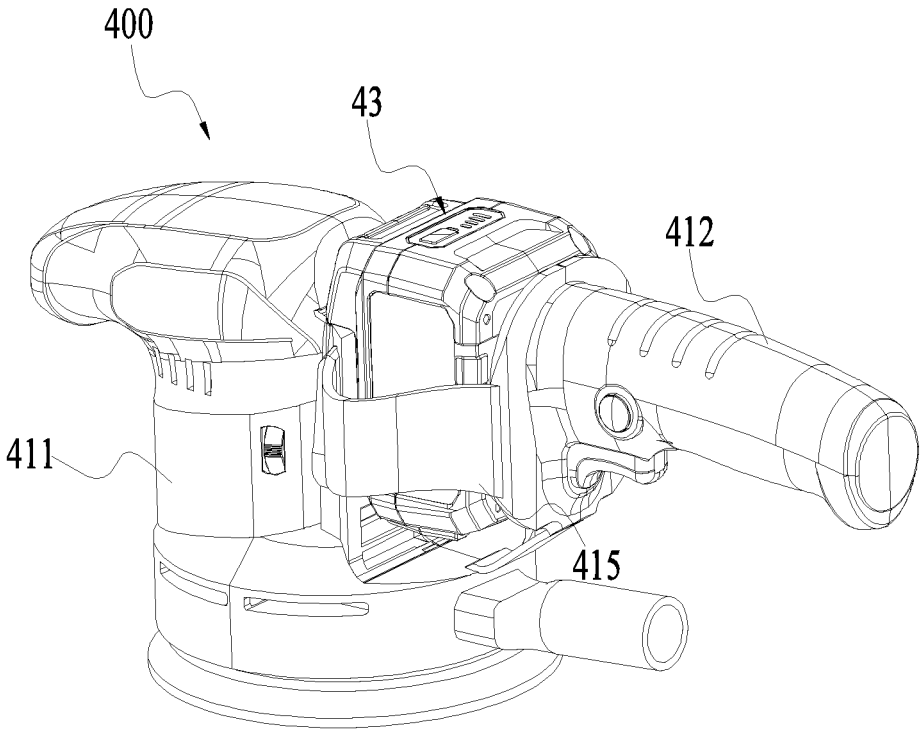
FIG. 11 is a perspective view of the sander of FIG. 10.

FIGS. 10 and 11 illustrate a sander 400. The sander 400 differs from the sander 100 only in that a structure of a connecting portion 415 is different from the structure of the connecting portion 115. In this example, a housing 41 includes multiple connecting portions 415 for connecting an accommodating portion 411 and a first grip portion 412. The multiple connecting portions 415 separate the accommodating portion 411 from the first grip portion 412. A receiving space 415*a* is enclosed by the multiple connecting portions 415. The receiving space 415*a* is opened in several directions and used for receiving a battery pack 43 so as to further facilitate heat dissipation of the battery pack 43. The parts described above with respect to sander 100 and suitable for sander 400 can all be applied to this example and, as such, the details are not described herein again.

Figure 12:
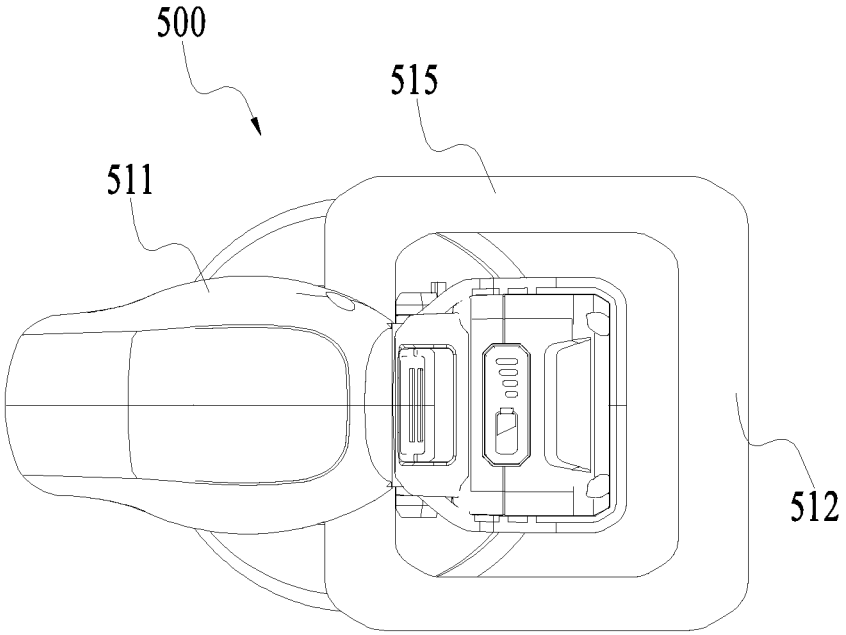
FIG. 12 is also a plan view of an exemplary sander.

FIG. 12 illustrates a sander 500. The sander 500 differs from the sander 100 only in that a connecting portion 515 has a different structure. In this example, the connecting portion 515 is configured to connect an accommodating portion 511 to a first grip portion 512. The number of connecting portions 515 is two. A D-shaped structure is substantially formed by the two connecting portions 515 and the first grip portion 512. The parts described above with respect to sander 100 and suitable for sander 500 can all be applied to this example and, as such, the details are not described herein again.

The above illustrates and describes basic principles, main features and advantages of the present disclosure. It is to be understood by those skilled in the art that the above embodiments do not limit the present disclosure in any form, and all solutions obtained by means of equivalent substitution or equivalent transformation fall within the protection scope of the present disclosure.

What is claimed is:

1. A sander, comprising:

a motor comprising a motor shaft configured to rotate around a first axis;

a housing comprising an accommodating portion configured to accommodate the motor;

a battery pack configured to power the motor;

a baseplate comprising a baseplate plane configured to arrange sandpaper thereon; and a driving assembly configured to drive the baseplate to make an eccentric motion, wherein the housing further comprises:

a first grip portion configured to be gripped by one hand of a user;

a second grip portion configured to be gripped by the other one hand of the user; and a coupling portion for detachably coupling the battery pack to the housing, wherein the battery pack is located between the first grip portion and the second grip portion when the battery pack is coupled to the housing, wherein the first grip portion, the battery pack, and the second grip portion are aligned along a straight line parallel to the baseplate plane, and wherein the first grip portion extends in the straight line and a length of the first grip portion in the straight line is greater than a length of the second grip portion in the straight line, and wherein the housing further comprises a connecting portion configured to connect the first grip portion to the accommodating portion and the connecting portion is provided with a receiving space for receiving the battery pack.

2. The sander of claim 1, wherein the coupling portion is located between the motor and the first grip portion in a direction parallel to the baseplate plane.

3. The sander of claim 1, wherein the battery pack is located between the accommodating portion and the first grip portion when the battery pack is coupled to the housing.

4. The sander of claim 1, wherein the coupling portion is further provided with a guide structure configured to guide the battery pack to be coupled to the coupling portion in a direction parallel to the first axis.

5. The sander of claim 1, wherein the housing is further provided with a recess configured to accommodate the battery pack, the coupling portion is located on a recess wall of the recess, and the recess is located between the accommodating portion and the first grip portion.

6. The sander of claim 1, wherein a projection of the first grip portion on a plane parallel to the baseplate plane is outside a projection of the baseplate on the plane.

7. The sander of claim 1, wherein the housing is further provided with a dust collection portion configured to mount a dust collection box and the first grip portion, the battery pack, and the dust collection portion are located on a same side of the motor when the battery pack is coupled to the housing.

* * * * *